US010689214B1

(12) United States Patent
Campbell et al.

(10) Patent No.: US 10,689,214 B1
(45) Date of Patent: Jun. 23, 2020

(54) MODULAR RADIAL IMPELLER DRUM WITH VARIABLE BLADE SEGMENTS FOR PRINTING DEVICES

(71) Applicant: Xerox Corporation, Norwalk, CT (US)

(72) Inventors: Richard A. Campbell, Rochester, NY (US); Daniel Raymond Knopp, Williamson, NY (US); Timothy Gordon Shelhart, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/228,294

(22) Filed: Dec. 20, 2018

(51) Int. Cl.
*B65H 5/00* (2006.01)
*B41J 11/00* (2006.01)
*B65H 29/20* (2006.01)

(52) U.S. Cl.
CPC ..... *B65H 5/00* (2013.01); *B41J 11/0015* (2013.01); *B65H 29/20* (2013.01); *B65H 2301/5144* (2013.01); *B65H 2404/40* (2013.01); *B65H 2404/411* (2013.01); *B65H 2404/42* (2013.01); *B65H 2406/1211* (2013.01); *B65H 2515/40* (2013.01)

(58) Field of Classification Search
CPC ..... B65H 5/00; B65H 5/228; B65H 29/20; B65H 2301/5144; B65H 2401/15; B65H 2404/40; B65H 2401/41; B65H 2401/411; B65H 2401/412; B65H 2401/4121; B65H 2401/42; B65H 2401/422; B65H 2401/431; B65H 2406/1211; B65H 2406/131; B65H 2515/40
See application file for complete search history.

(56) References Cited

U.S. PATENT DOCUMENTS

2014/0338511 A1* 11/2014 Grill ..... F16D 1/0858 83/446
2016/0137442 A1* 5/2016 Rietbergen ..... B65H 29/56 271/276

* cited by examiner

*Primary Examiner* — Prasad V Gokhale

(57) ABSTRACT

A modular radial impeller drum for cooling print media in a printing device are disclosed. For example, the modular radial impeller drum includes a plurality of impeller modules coupled together to form a surface to transport the print media. Each one of the plurality of impeller modules includes a cylindrical outer surface, a cylindrical center axis inside of the cylindrical outer surface, and a plurality of impeller blades coupled between the cylindrical outer surface and the cylindrical center axis, wherein the plurality of impeller blades the plurality of impeller modules is varied across a length of the modular radial impeller drum.

20 Claims, 6 Drawing Sheets

MODULAR RADIAL IMPELLER DRUM WITH VARIABLE BLADE SEGMENTS FOR PRINTING DEVICES

The present disclosure relates generally to printing devices and, more particularly, to a modular radial impeller drum with variable blade segments for printing devices to improve media cooling.

BACKGROUND

Printing devices can be used to print images on a print media. The printing devices may include a paper path where the print media may travel within the printing devices to receive the image that is printed. The print process may include various operations along the paper path. Some of the operations may generate heat. Large amounts of heat within the printing device may cause certain electronic components to fail or malfunction.

In addition, the printing devices are being used to print on larger and wider sheets of print media. Thus, the internal rollers that are used to transport the larger print media are also growing in size and length. Using traditional extrusion techniques to manufacture these internal rollers may become more difficult.

SUMMARY

According to aspects illustrated herein, there is provided a modular radial impeller drum for cooling print media in a printing device. One disclosed feature of the embodiments is a modular radial impeller drum for cooling print media in a printing device that comprises a plurality of impeller modules coupled together to form a surface to transport the print media, wherein each one of the plurality of impeller modules includes a cylindrical outer surface, a cylindrical center axis inside of the cylindrical outer surface, and a plurality of impeller blades coupled between the cylindrical outer surface and the cylindrical center axis, wherein the plurality of impeller blades the plurality of impeller modules is varied across a length of the modular radial impeller drum.

Another disclosed feature of the embodiments is a cooler module of a printing device. In one embodiment, the cooler module of a printing device comprises at least one modular radial impeller drum and at least one blower coupled to an end of the first modular radial impeller drum to provide an air flow across a length of the at least one modular radial impeller drum, wherein the at least one modular radial impeller drum maintains the air flow at a constant velocity across the length of the at least one modular radial impeller drum, wherein the at least one modular radial impeller drum comprises a plurality of impeller modules, wherein each one of the plurality of impeller modules, comprises a cylindrical outer surface, a cylindrical center axis inside of the cylindrical outer surface, and a plurality of impeller blades coupled between the cylindrical outer surface and the cylindrical center axis, wherein the plurality of impeller blades the plurality of impeller modules is varied across a length of the modular radial impeller drum.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses a modular radial impeller drum for printing devices. As discussed above, printing devices may use operations that generate large amounts of heat. The printing devices may include some cooling devices (e.g., an internal impeller drum). Current impeller drums use an extruded component. However, the current designs of the impeller drum may not efficiently move air across the drum. As a result, an end of the impeller drum furthest away from an air source may be hotter than an end of the impeller drum closest to the air source.

In addition, as print media becomes larger and wider (e.g., 24 inches in width, 30 inches in width, and the like), the cost to manufacture the impeller drum may also increase. The tools to manufacture such a long impeller drum may rise as the length requirements increase.

The present disclosure provides a modular radial impeller drum for printing devices. The modular radial impeller drum may be fabricated by coupling together a plurality of individual radial impeller modules. The impeller modules may be casted. As a result, a single relatively low cost cast may be used. In addition, the impeller modules may be coupled together to form a modular radial impeller drum of any length to accommodate any size or width of print media.

In addition, the impeller blades in the impeller modules may be designed to improve the air flow through the modular radial impeller drum. For example, the impeller modules may be coupled together such that the impeller blades are aligned in a helical pattern through a length, or central rotational axis, of the modular radial impeller drum. As a result, the velocity of the air flow through the modular radial impeller drum may be kept constant. The constant velocity of the air flow may help to maintain a consistent cooling efficiency or performance across a length of the modular radial impeller drum.

Figure 1:
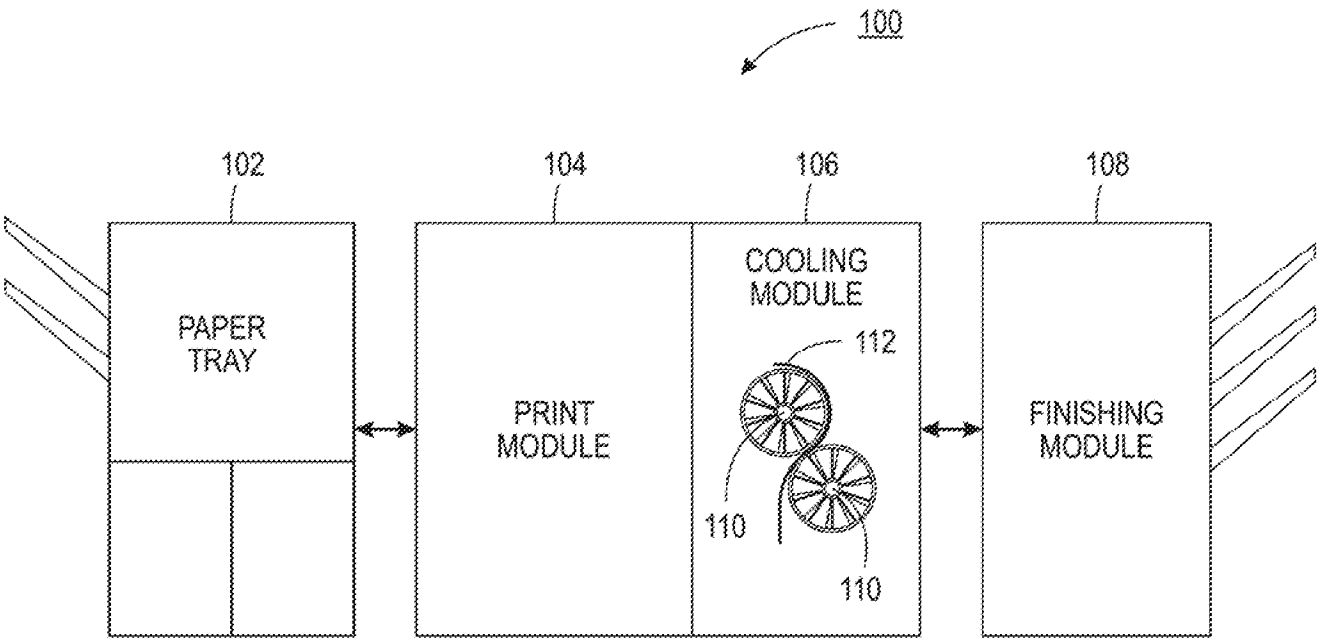
FIG. 1 illustrates an example printing device of the present disclosure.

FIG. 1 illustrates an example printing device 100 of the present disclosure. In one embodiment, the printing device 100 may include a paper tray 102, a print module 104, a cooling module 106, and a finishing module 108. In one embodiment, the paper tray 102 may include storage trays that store a print media 112. The print media 112 may be paper or a continuous web of paper.

In one embodiment, the print module 104 may include a paper path and printing components to print an image onto the print media 112. The print module 104 may include a digital front end (DFE) to convert a desired print job into a printer description language (PDL) that can be used by the print module 104 to print the print job.

It should be noted that the print module 104 may include additional components that are not shown. For example, the print module 104 may include printheads, toner, a fuser, various transport paths, a controller or processor, and the like.

In one embodiment, the cooling module 106 may cool the print media 112 after the print module 104. Various operations of the print module 104 may generate large amounts of heat. The print media 112 may absorb heat during these operations. The cooling module 106 may be used to cool the print media 112. In addition, the cooling module 106 may be used to perform other operations such as removing solvent from certain types of ink, and the like.

In one embodiment, the cooling module 106 of the present disclosure may include at least one modular radial impeller drum 110. In one embodiment, the cooling module 106 may include a pair of modular radial impeller drums 110. The modular radial impeller drums 110 may be adjacent to one another. The print media 112 may pass between the outer surfaces of the modular radial impeller drums 110. The pair of modular radial impeller drums 110 may rotate to move the print media 112 between the modular radial impeller drums 110. Each modular radial impeller drum 110 may cool a respective side of the print media 112.

The print media 112 may then be transported to the finishing module 108. The finishing module 108 may perform optional finishing features such as stapling, collating, and the like, and output the print media 112 with completed print jobs in an output tray.

In one example, the print media 112 may be relatively wide print media 112. For example, the print media 112 may have widths of 20 inches or wider. For example, the print media 112 may have widths of over 30 inches. Thus, the modular radial impeller drums 110 may have a length that is approximately the same as the width of the print media 112.

As noted above, previously fabricated impeller drum designs were expensive and difficult to manufacture. For example, extruding an impeller drum have a length of over 20 inches was difficult with the impeller blades inside the impeller drum having the same length. However, the present disclosure provides the modular radial impeller drum 110 that is manufactured via coupling of a plurality of modular impellers. Each modular impeller may be manufactured via a casting process. Since each modular impeller has a relatively small length, the casting tools may be relatively inexpensive. In addition, the modular design may allow any number of modular impellers to be coupled together to form a modular radial impeller drum 110 having any desired length for any particular application.

It should be noted that the printing device 100 has been simplified for ease of explanation. The printing device 100 may include additional features and/or components that are not shown. For example, the printing device 100 may include a network interface to establish wireless communication sessions with other endpoint devices, a user interface (e.g., a touch screen graphical user interface), multi-function capabilities (e.g., scan, copy, or fax), and the like.

Figure 2:
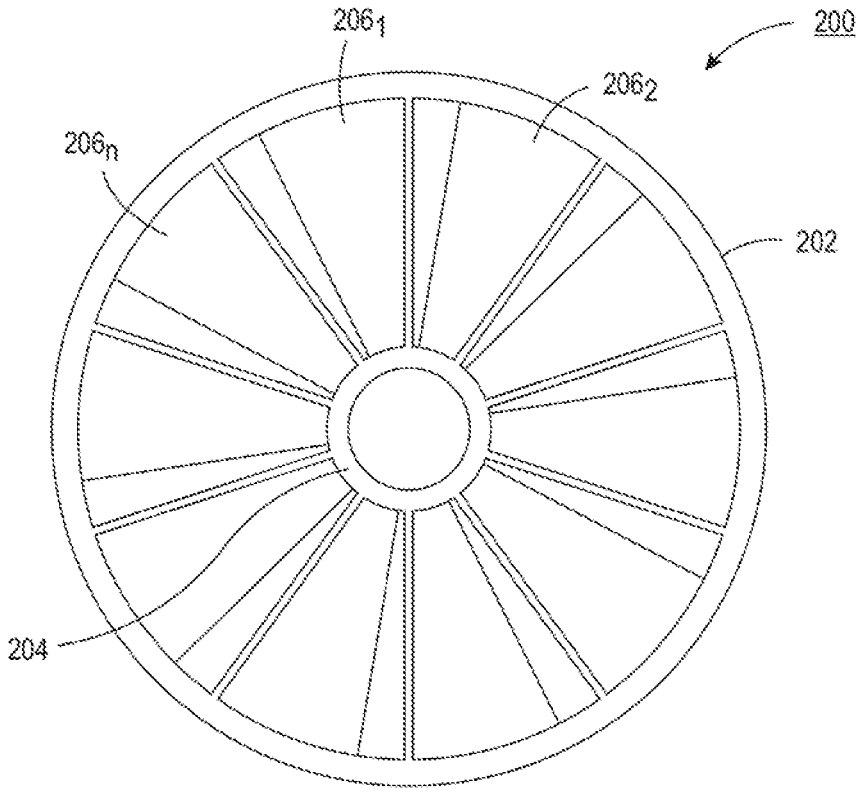
FIG. 2 illustrates an example top view of a modular impeller the present disclosure.

FIG. 2 illustrates a top view of an example modular impeller 200 of the present disclosure. In one embodiment, the modular impeller 200 may include a cylindrical outer surface 202 and a cylindrical center axis 204. The cylindrical center axis 204 may be located concentric to the cylindrical outer surface 202. In other words, the cylindrical center axis 204 may be located in a center inside portion of the cylindrical outer surface 202.

In one embodiment, a plurality of impeller blades $\mathbf{206}_1$ to $\mathbf{206}_n$ (hereinafter also referred to individually as a impeller blade 206 or collectively as impeller blades 206) may be coupled between the cylindrical outer surface 202 and the cylindrical center axis 204. In other words, the impeller blades 206 may be connected to an inner side of the cylindrical outer surface 202 and an outer side of the cylindrical center axis 204.

In one embodiment, each one of the impeller blades 206 may be symmetrically located around the cylindrical center axis 204. In one embodiment, each one of the impeller blades 206 may be angled or have a curved shape.

In one embodiment, the modular impeller 200 may be fabricated from a casting tool. The modular impeller 200 may be fabricated from any type of conductive metal that may help dissipate heat away from the print media 112. In one embodiment, the modular impeller 200 may be fabricated from aluminum in the casting tool. Using a conductive metal may help improve the heat dissipation of the modular radial impeller drum 110. For example, the modular impeller 200 itself can serve as a heat sink in addition to the improved air flow provided by the design of the impeller blades 206 and the modular impeller 200.

In one embodiment, the angle or amount of curvature may be a function of a desired air flow velocity across a length of the modular radial impeller drum 110 and an ability for the casting tool to form the modular impeller 200 and be removed after the modular impeller 200 is formed inside. In other words, if the impeller blades are designed to be more angled or have more curvature, the impeller blades may generate more air velocity or throughput of the air. However, if the impeller blades are too angled or have too much curvature, the casting tool may not be able to close between the impeller blades 206 in the casting tool to form the modular impeller 200.

In one embodiment, the impeller blades 206 may be varied in shape along a length of the modular radial impeller drum 110 to maintain a constant air flow velocity across the length of the modular radial impeller drum 110. In one embodiment, "constant air flow velocity" may be defined to mean to have an airflow in each modular impeller 200 that is within a predefined threshold of an average air flow velocity of the entire length of the modular radial impeller drum 110. The predefined threshold may be an absolute value (e.g., within 1 m/s, 0.5 m/s, and the like) or a percentage (e.g., within 1 percent, 0.5 percent, 5 percent, and the like). In one embodiment, the shape may include changing a surface area of the impeller blade 206 or changing a pitch or an amount of curvature of the impeller blade 206. In one embodiment, the number of impeller blades 206 may also be varied.

In one embodiment, the shape and/or number of impeller blades 206 may be varied from a least amount of air flow closest to an air source to an increasing amount of air flow at the end furthest away from the air source. For example, the air flow may decrease across the length of the modular radial impeller drum 110 as the air flow moves away from the air source. The impeller blades 206 of modular impeller 200 may be designed to gradually increase the air flow to compensate for the loss of air flow velocity and maintain a constant air flow velocity across the length of the modular radial impeller drum 110.

Figure 3:
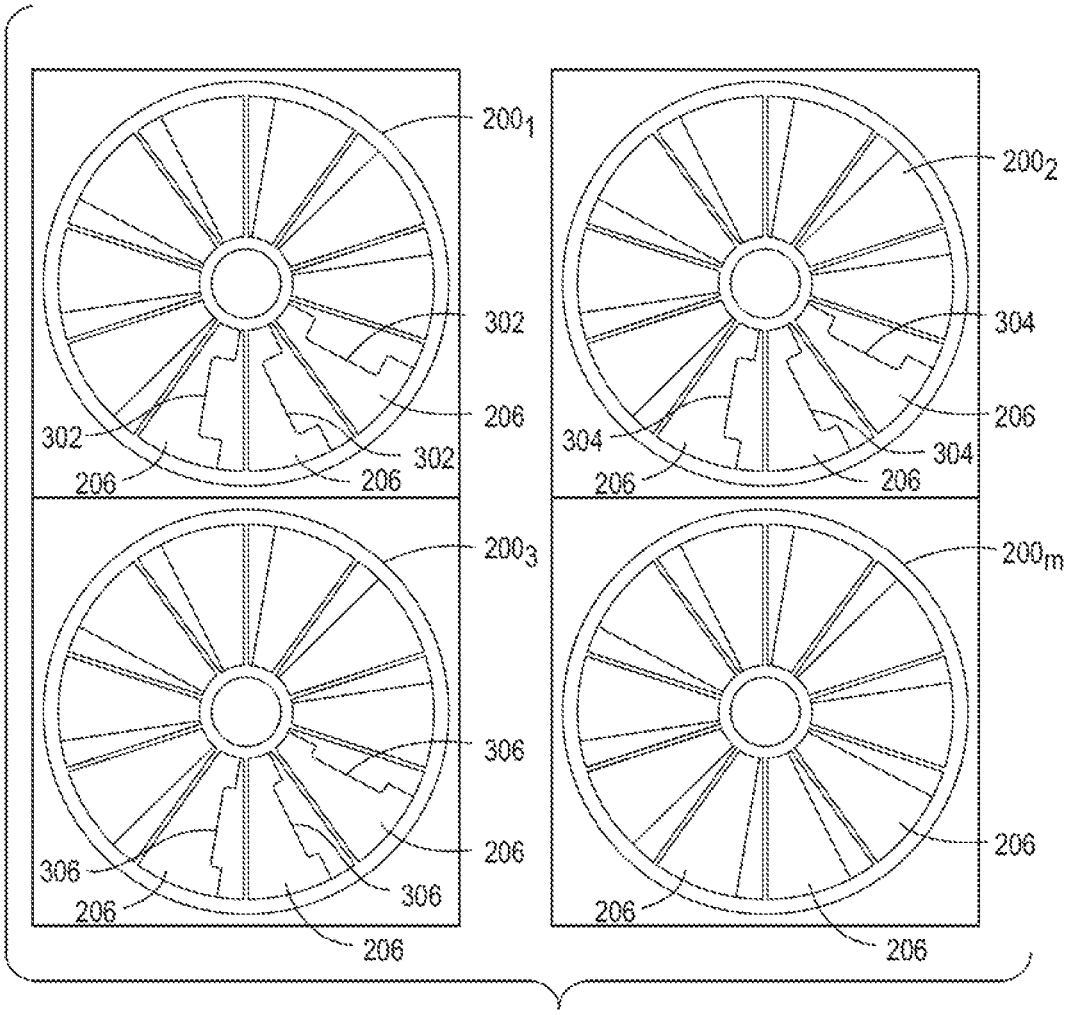
FIG. 3 illustrates an example of different modular impellers where the variable impeller blades are fabricated by remove portions of the impeller blades.

FIG. 3 illustrates an example of different modular impellers 200 where the impeller blades that are fabricated are varied by removing portions of the impeller blades 206. FIG. 3 illustrates examples of modular impellers $\mathbf{200}_1$, $\mathbf{200}_2$, $\mathbf{200}_3$, and $\mathbf{200}_m$. In one embodiment, the modular impeller $\mathbf{200}_1$ may be closest to an air source and the modular impeller $\mathbf{200}_m$ may be furthest from the air source.

In one embodiment, the modular impellers $\mathbf{200}_1$, $\mathbf{200}_2$, $\mathbf{200}_3$, and $\mathbf{200}_m$ may be fabricated from a single casting tool. As a result, fabrication costs may be minimized as the same casting tool can be used to fabricate all of the modular impellers 200.

In one embodiment, after the modular impellers $\mathbf{200}_1$, $\mathbf{200}_2$, $\mathbf{200}_3$, and $\mathbf{200}_m$ are fabricated, the impeller blades 206 may be varied to adjust the amount of air flow provided by each modular impeller $\mathbf{200}_1$, $\mathbf{200}_2$, $\mathbf{200}_3$, and $\mathbf{200}_m$. As noted above the velocity of the air flow through the modular impeller $\mathbf{200}_1$ may be greatest as it is closest to the air source. Thus, the amount of air flow provided by the modular impeller $\mathbf{200}_1$ may be the smallest. The velocity of the air flow through each subsequent modular impeller $\mathbf{200}_2$ to $\mathbf{200}_m$ may be gradually slower. As a result, the amount of air flow through each subsequent modular impeller $\mathbf{200}_2$ to $\mathbf{200}_m$ may be gradually increased. The modular impeller $\mathbf{200}_m$ may provide the greatest amount of air flow. In other words, the amount of air flow provided by the modular impeller $\mathbf{200}_m$ may be greater than modular impeller $\mathbf{200}_{m-1}$, which may be greater than modular impeller $\mathbf{200}_{m-2}$, and so forth all the way to modular impeller $\mathbf{200}_1$.

In FIG. 3, the impeller blades 206 of the modular impeller $\mathbf{200}_1$ may be modified to have a cutout 302 by removing an area from the impeller blades 206. Although the area of the cutout 302 is removed from three impeller blades 206 it should be noted that the area of cutout 302 may be removed from any number of impeller blades. Also, although the area of the cutout 302 is removed from three consecutive impeller blades 206, it should be noted that the area of the cutout 302 may be removed from any sequence of impeller blades 206 (e.g., every other impeller blade 206, equidistantly spaced impeller blades 206, random impeller blades 206, and the like).

Although the cutout 302 is shown to be a rectangle, it should be noted that the cutout 302 may have any shape. For example, the cutout 302 that is removed may be a semicircle, may be multiple sections that are equal to the cutout 302, may be openings inside of the impeller blade 206, and the like.

In one embodiment, the area of the cutout 302 may have the largest surface area removed. As a result, the air flow generated by the impeller blades 206 may be the smallest. For example, more impeller blade surface area may generate more air flow.

The impeller blade $\mathbf{206}_2$ may have a cutout 304 that is removed from the impeller blades 206. The cutout 304 may be removed from the same impeller blades 206 as the impeller blades 206 of the modular impeller $\mathbf{200}_1$ or from impeller blades 206 of the modular impeller $\mathbf{200}_2$ that are different than the impeller blades $\mathbf{206}_1$ of the modular impeller $\mathbf{200}_1$ having the cutout 302.

In one embodiment, the area of the cutout 304 may be smaller than the area of the cutout 302. As a result, the impeller module $\mathbf{200}_2$ may generate more air flow than the impeller module $\mathbf{200}_1$. Thus, the impeller module $\mathbf{200}_2$ may help the velocity of the air flow remain constant as it slows down moving through the impeller module $\mathbf{200}_1$.

The impeller blade $\mathbf{206}_3$ may have a cutout 306 that is removed from the impeller blades 206. The cutout 306 may be removed from the same impeller blades 206 as the impeller blades 206 of the modular impeller $\mathbf{200}_2$ or from impeller blades 206 of the modular impeller $\mathbf{200}_3$ that are different than the impeller blades 206 of the modular impeller $\mathbf{200}_2$ having the cutout 304.

In one embodiment, the area of the cutout 306 may be smaller than the area of the cutout 304. As a result, the impeller module $\mathbf{200}_3$ may generate more air flow than the impeller module $\mathbf{200}_2$. Thus, the impeller module $\mathbf{200}_3$ may help the velocity of the air flow remain constant as it slows down moving through the impeller modules $\mathbf{200}_1$ and $\mathbf{200}_2$.

This process may be repeated until reaching the last impeller module $\mathbf{200}_m$. The impeller module $\mathbf{200}_m$ may have no cutouts in the impeller blades 206. Thus, the impeller module $\mathbf{200}_m$ may have the maximum surface area of impeller blades to generate the most air flow. This may help maintain the velocity of the air flow as it reaches the end of the modular radial impeller drum 110.

In one embodiment, the size of the cutouts 302, 304, and 306 and the incremental change in size of the cutouts from cutout 302 to cutout 304 and cutout 304 to cutout 306, and so forth, may vary for each particular application. For example, the surface area to be cut and the incremental change for each modular impeller 200 may be based on a calculated air flow velocity across the length of the modular radial impeller drum 110, the initial velocity provided by the air source, pressure drop across each modular impeller 200, and the like.

Figure 4:
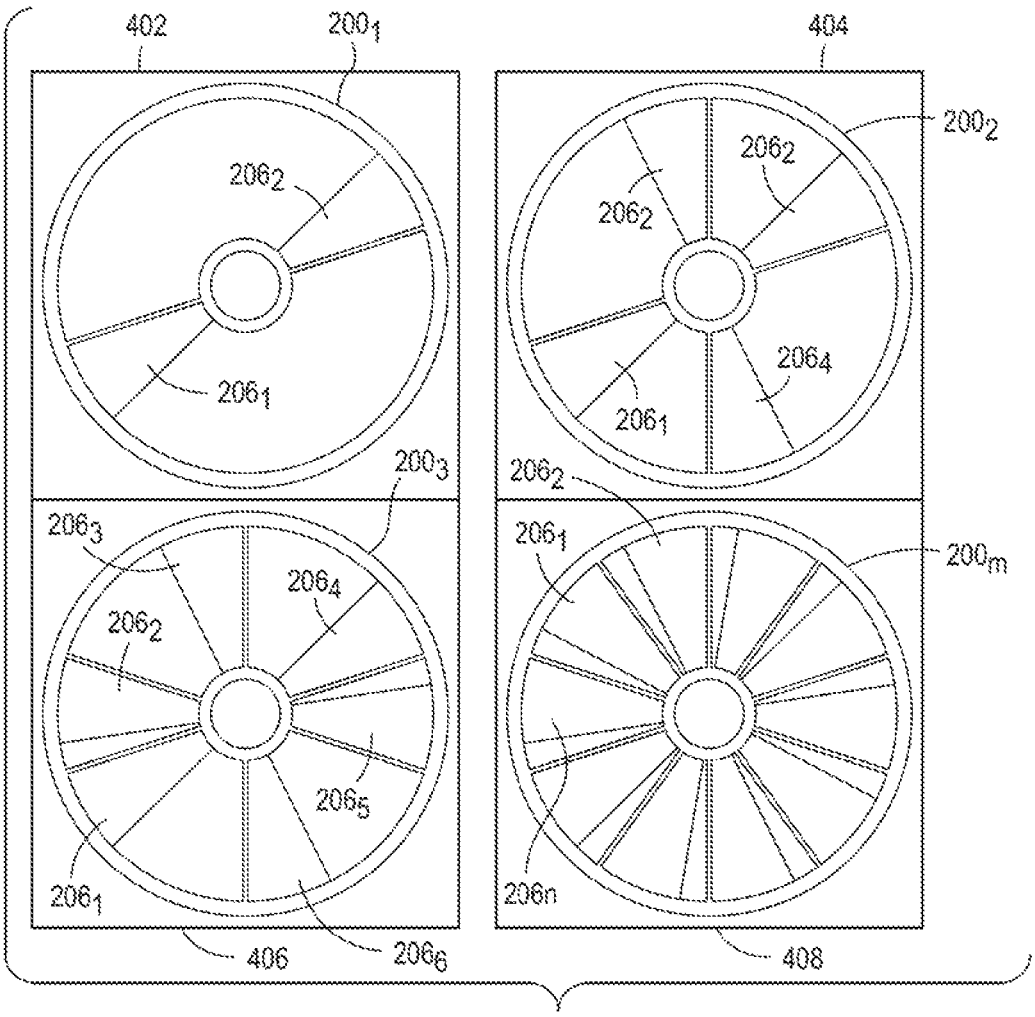
FIG. 4 illustrates an example of different modular impellers where the variable impeller blades are fabricated by different casting tools.

FIG. 4 illustrates an example of different modular impellers 200 that are fabricated by different casting tools to have different number of impeller blades 206. FIG. 4 illustrates examples of modular impellers $\mathbf{200}_1$, $\mathbf{200}_2$, $\mathbf{200}_3$, and $\mathbf{200}_m$. In one embodiment, the modular impeller $\mathbf{200}_1$ may be closest to an air source and the modular impeller $\mathbf{200}_m$ may be furthest from the air source.

In one embodiment, the modular impellers $\mathbf{200}_1$, $\mathbf{200}_2$, $\mathbf{200}_3$, and $\mathbf{200}_m$ may be fabricated from different casting tools. For example, each modular impeller $\mathbf{200}_1$, $\mathbf{200}_2$, $\mathbf{200}_3$, and $\mathbf{200}_m$ may have a different casting mold to form the respective modular impellers $\mathbf{200}_1$, $\mathbf{200}_2$, $\mathbf{200}_3$, and $\mathbf{200}_m$. However, the upfront cost in providing different casting tools may be offset by lower costs in post processing each modular impeller $\mathbf{200}_1$, $\mathbf{200}_2$, $\mathbf{200}_3$, and $\mathbf{200}_m$ to vary the impeller blades 206.

In one embodiment, the modular impellers $\mathbf{200}_1$, $\mathbf{200}_2$, $\mathbf{200}_3$, and $\mathbf{200}_m$ may be fabricated to have a different number of impeller blades 206. For example, the modular impeller $\mathbf{200}_1$ may have two impeller blades $\mathbf{206}_1$ and $\mathbf{206}_2$. The modular impeller $\mathbf{200}_1$ may be closest to the air source. As a result, the modular impeller $\mathbf{200}_1$ may have the least number of impeller blades 206 as the modular impeller 200 may provide a lowest amount of air flow.

In one embodiment, the modular impeller $\mathbf{200}_2$ may be fabricated to have four impeller blades $\mathbf{206}_1$ to $\mathbf{206}_4$. The modular impeller $\mathbf{200}_2$ may have more impeller blades 206 than the modular impeller $\mathbf{200}_1$ as it is further away from the air source. For example, more impeller blades 206 may provide greater air flow, and therefore, help to increase air flow velocity as it slows down to maintain a constant air flow velocity.

In one embodiment, the modular impeller $\mathbf{200}_3$ may be fabricated to have six impeller blades $\mathbf{206}_1$ to $\mathbf{206}_6$. The modular impeller $\mathbf{200}_3$ may have more impeller blades 206 than the modular impeller $\mathbf{200}_2$ as it is further away from the air source.

In one embodiment, the number of impeller blades 206 may be gradually increased up to the last modular impeller $200_m$. The modular impeller $200_m$ may have the maximum number of impeller blades $206_1$ to $206_n$ to provide a maximum airflow.

Although each modular impeller 200 is shown as increasing the number of impeller blades 206 by two, it should be noted that the increase may be any increment of impeller blades. For example, each modular impeller 200 may increase by one impeller blade, by three impeller blades, and the like.

In addition, the gradual increase in impeller blades 206 may be located anywhere around the cylindrical center axis 204 of the module impeller 200. In other words, the additional impeller blades 206 for each subsequent adjacent impeller module 200 do not need to be symmetrically placed.

In one embodiment, some impeller modules 200 may have the same number of impeller blades 206. For example, if six impeller modules 200 are deployed, the first and second impeller module 200 may have the same number of impeller blades 206. The third and fourth impeller module 200 may have the same number of impeller blades 206, but more impeller blades 206 than the first and second impeller module 200, and so forth.

Figure 5:
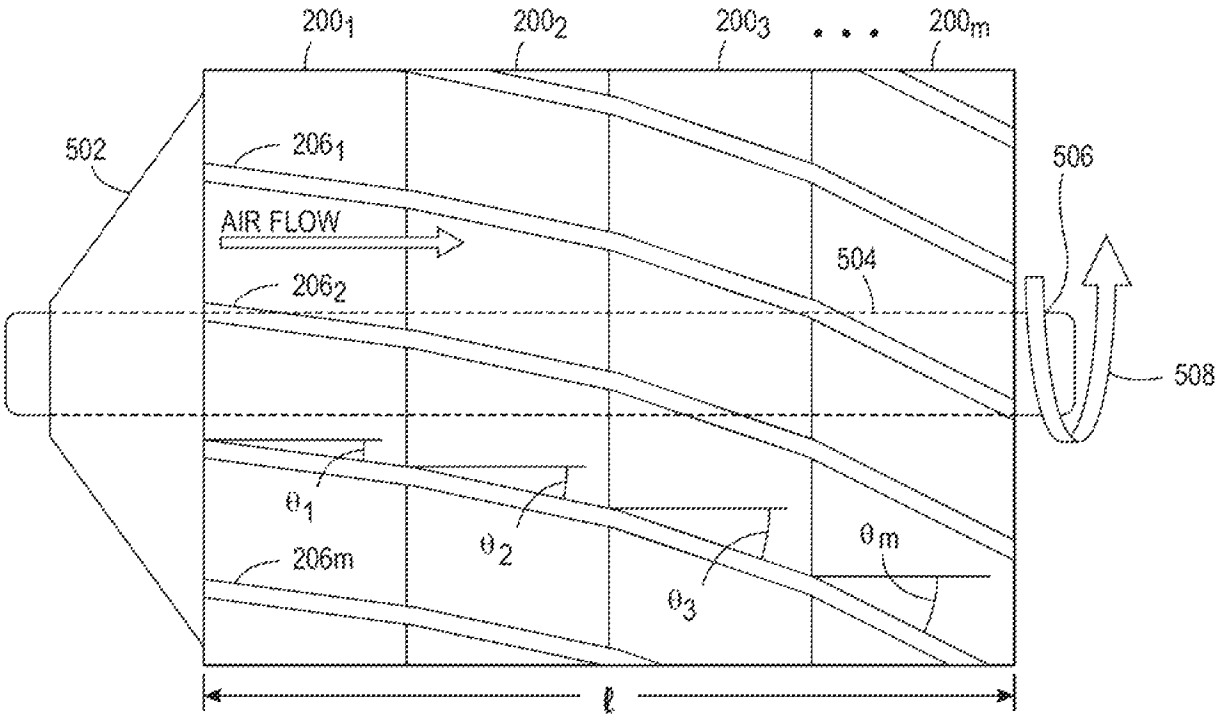
FIG. 5 illustrates a side cross-sectional view of an example of the modular radial impeller drum of the present disclosure with varying blade curvature along a length of the modular radial impeller drum.

FIG. 5 illustrates a side cross-sectional view of an example of the modular radial impeller drum 110 of the present disclosure with modular impellers 200 that have impeller blades 206 with varying blade curvature or pitch. In one embodiment, FIG. 5 shows how the modular impellers 200 may be coupled together via a shaft 504. The shaft 504 may be fitted through the cylindrical central axis 204 of each of the modular impellers 200. In one example, a locking nut 506 may be coupled to an outermost modular impeller furthest away from a blower 502 (e.g., the modular impeller $200_m$).

In one example, the opposite end of the shaft 504 may be coupled to the blower 502 or a motor that drives the shaft 504 to rotate the modular impellers 200. In one embodiment, the blower 502 may provide the airflow. In another example, the blower 502 may be optional and the modular impellers 200 may be driven to generate the air flow on their own.

In one example, the pitch or blade curvature for each one of the blades 206 of each one of the modular impellers 200 may be gradually changed along a length of the modular radial impeller drum 110. The length may be defined as a distance from one edge of the first modular impeller $200_1$ to an opposite edge of the last modular impeller $200_m$, as shown by a dimension "l" in FIG. 5.

In one embodiment, the pitch of each one of the blades 206 of the modular impellers 200 may be changed by gradually increasing the pitch. The pitch may be defined as an angle θ formed by a plane parallel to the shaft 504 and an end of the impeller blade 206 as shown in FIG. 5.

In one embodiment, the modular impeller $200_1$ may have impeller blades 206 that have a pitch of $\theta_1$. Impeller blades 206 of the modular impeller $200_2$ may have a pitch $\theta_2$, where $\theta_2$ is greater than $\theta_1$. The pitch of the impeller blades 206 of the modular impeller $200_3$ may have a pitch of $\theta_3$, where $\theta_3$ is greater than $\theta_2$, and so forth, all the way to the modular impeller $200_m$. The impeller blades 206 of the modular impeller $200_m$ may have a pitch of $\theta_m$ that is the highest pitch of all of the modular impellers 200.

In one embodiment, the impeller blades 200 of each one of the modular impellers 200 may be aligned, as shown in FIG. 5. The impeller blades 200 may be aligned to appear as a continuous line in the cross-sectional view. In one embodiment, the modular impellers 200 may be aligned via a mechanical feature built into the modular impellers 200. For example, a raised tab may be located on the outer edge of the cylindrical outer surface 202 of the modular impellers 200.

Although three separate ways to vary the impeller blades 206 are illustrated in FIGS. 3-5 and discussed above, it should be noted that the methods may be combined. For example, the impeller blades 206 may be varied by using the cutouts illustrated in FIG. 3, combined with varying the number of impeller blades 206 illustrated in FIG. 4 and/or the varying pitch of the impeller blades 206 illustrated in FIG. 5.

Figure 6:
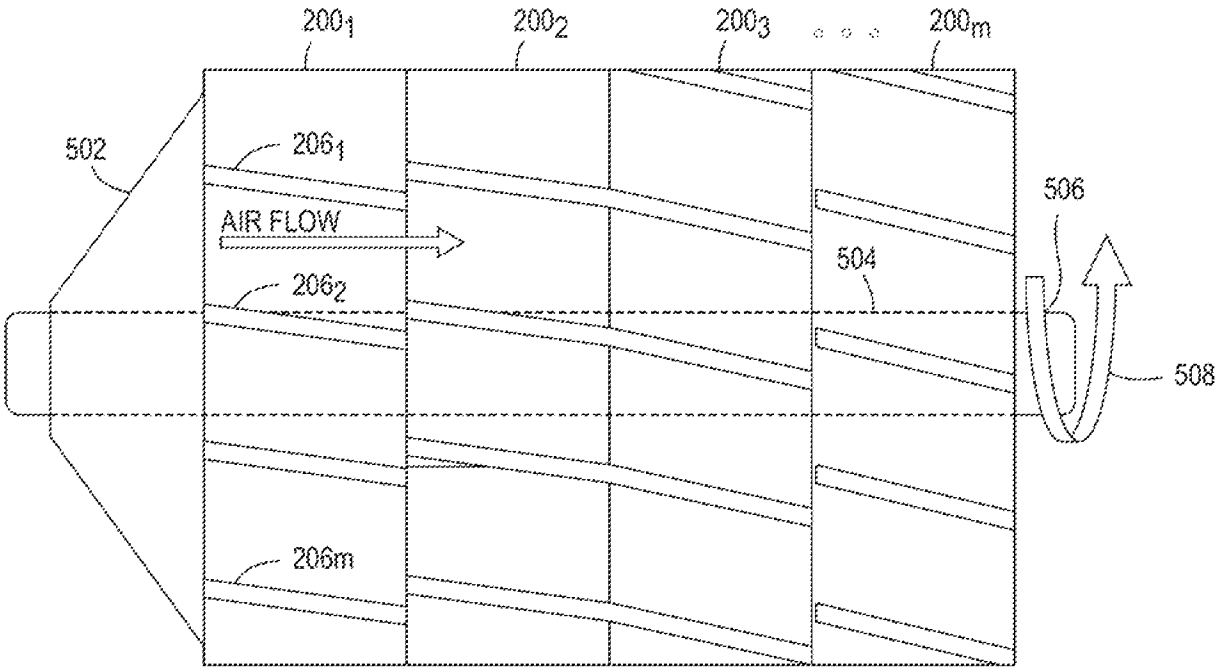
FIG. 6 illustrates a side cross-sectional view of an example of the modular radial impeller drum with varying number of impeller blades along a length of the modular radial impeller drum.

FIG. 6 illustrates a cross-sectional side view of another example of the modular radial impeller drum 110 with varying number of impeller blades 206 along a length of the modular radial impeller drum 110. FIG. 6 illustrates an example similar to the varying number of impeller blades 206 illustrated in FIG. 4, and described above.

In one embodiment, the impeller blades 206 of some of the modular impellers 200 may be aligned, while the impeller blades 206 of other modular impellers 200 may be misaligned. The alignment and misalignment of the impeller blades 206 may also be used to help control the velocity of the air flow across each modular impeller 200 and the length of the modular radial impeller drum 110.

FIG. 6 illustrates an embodiment, where the impeller blades 206 of the modular impellers $200_2$ and $200_3$ are aligned. However, the impeller blades 206 of the modular impellers $200_1$ and $200_m$ may be misaligned with the impeller blades 206 of the modular impellers $200_2$ and $200_3$. In other words, the impeller blades 206 of the modular impeller $200_1$ and $200_m$ may not be aligned with the impeller blades 206 of the modular impellers $200_2$ and $200_3$.

Thus, the present disclosure provides various ways to vary the impeller blades 206 of the modular impellers 200. The impeller blades 206 may be varied to change the amount of surface area, the number of impeller blades 206, the pitch of the impeller blades 206, or any combination thereof. Varying the impeller blades 206 may allow each modular impeller 200 to generate or promote a different amount of air flow. The amount of air flow generated by each modular impeller 200 may be gradually increased across a length of the modular radial impeller drum 110. Gradually increasing the amount of air flow may help to compensate for the gradual decline of velocity of the air flow as the air flow moves further away from the air source. Maintaining a constant velocity of the air flow may help to improve the efficiency of the cooling provided by the modular radial impeller drum 110. In addition, maintaining a constant velocity of air flow across the modular radial impeller drum 110 may also provide an even cooling across the entire length of the modular radial impeller drum 110.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A modular radial impeller drum for cooling print media in a printing device, comprising:

a plurality of impeller modules coupled together to form a surface to transport the print media, wherein each one of the plurality of impeller modules, comprises:

a cylindrical outer surface;

a cylindrical center axis inside of the cylindrical outer surface; and a plurality of impeller blades coupled between the cylindrical outer surface and the cylindrical center axis, wherein the plurality of impeller blades of the plurality of impeller modules is varied across a length of the modular radial impeller drum.

2. The modular radial impeller drum of claim 1, wherein the plurality of impeller blades are varied by removing a portion of a surface area of at least one of the plurality of impeller blades.

3. The modular radial impeller drum of claim 2, wherein the plurality of impeller blades have different amounts of the surface area removed for each one of the plurality of impeller modules.

4. The modular radial impeller drum of claim 3, wherein an amount of the surface area that is removed for the plurality of impeller blades increases for impeller modules of the plurality of impeller modules that are further away from an air source.

5. The modular radial impeller drum of claim 1, wherein the plurality of impeller blades are varied by changing a number of the plurality of impeller blades on the plurality of impeller modules.

6. The modular radial impeller drum of claim 5, wherein the number of the plurality of impeller blades increases for impeller modules of the plurality of impeller modules that are further away from an air source.

7. The modular radial impeller drum of claim 1, wherein the plurality of impeller blades of the plurality of impeller modules is varied by changing a pitch of the plurality of impeller blades of each one of the plurality of impeller modules.

8. The a modular radial impeller drum of claim 7, wherein the pitch of the plurality of impeller blades is increased as the plurality of impeller modules are located further away from an air source.

9. The modular radial impeller drum of claim 8, wherein the plurality of impeller modules are coupled together such that the plurality of impeller blades of each one of the plurality of impeller modules is aligned with increasing pitch.

10. The modular radial impeller drum of claim 1, wherein the plurality of impeller blades of a first subset of the plurality of impeller modules are aligned and the plurality of impeller blades of a second subset of the plurality of impeller modules are misaligned.

11. The modular radial impeller drum of claim 1, wherein the length of the modular radial impeller drum is greater than 20 inches.

12. The modular radial impeller drum of claim 1, wherein the each one of the plurality of impeller modules are fabricated from aluminum.

13. A cooler module of a printing device, comprising:

at least one modular radial impeller drum; and at least one blower coupled to an end of the first modular radial impeller drum to provide an air flow across a length of the at least one modular radial impeller drum, wherein the at least one modular radial impeller drum maintains the air flow at a constant velocity across the length of the at least one modular radial impeller drum, wherein the at least one modular radial impeller drum comprises a plurality of impeller modules, wherein each one of the plurality of impeller modules, comprises:

a cylindrical outer surface;

a cylindrical center axis inside of the cylindrical outer surface; and a plurality of impeller blades coupled between the cylindrical outer surface and the cylindrical center axis, wherein the plurality of impeller blades of the plurality of impeller modules is varied across the length of the modular radial impeller drum to maintain the constant velocity of the air flow.

14. The cooler module of the printing device of claim 13, wherein the at least one modular radial impeller drum comprises a plurality of modular radial impeller drums located adjacent to each other and to receive a print media between the plurality of modular radial impeller drums.

15. The cooler module of the printing device of claim 14, wherein the at least one blower comprises a plurality of blowers, wherein each one of the plurality of blowers are coupled to an end of a respective one of the plurality of modular radial impeller drums.

16. The cooler module of the printing device of claim 13, wherein the plurality of impeller blades are varied by removing a portion of a surface area of at least one of the plurality of impeller blades.

17. The cooler module of the printing device of claim 13, wherein the plurality of impeller blades have different amounts of the surface area removed for each one of the plurality of impeller modules.

18. The cooler module of the printing device of claim 13, wherein the plurality of impeller blades are varied by changing a number of the plurality of impeller blades on the plurality of impeller modules.

19. The cooler module of the printing device of claim 13, wherein the plurality of impeller blades of the plurality of impeller modules is varied by changing a pitch of the plurality of impeller blades of each one of the plurality of impeller modules.

20. A modular radial impeller drum for cooling print media in a printing device, comprising:

a plurality of impeller modules coupled together to form a surface to transport the print media that has a length that is approximately equal to a width of the print media, wherein each one of the plurality of impeller modules are casted from aluminum and comprises:

a cylindrical outer surface;

a cylindrical center axis inside of the cylindrical outer surface, wherein the plurality of impeller modules are coupled together via a shaft that runs through the cylindrical center axis of each one of the plurality of impeller modules; and a plurality of impeller blades coupled between the cylindrical outer surface and the cylindrical center axis, wherein each one of the plurality of impeller blades are angled, wherein the plurality of impeller blades of the plurality of impeller modules is varied by at least one of: a change in surface area of the plurality of impeller blades, a number of impeller blades per impeller module, or a change in pitch of the plurality of impeller blades of each one of the plurality of impeller modules, across a length of the modular radial impeller drum.

* * * * *